United States Patent [19]

Chen

[11] Patent Number: 4,759,541

[45] **Date of Patent: * Jul. 26, 1988**

[54] BABY'S WALKER WITH HEIGHT ADJUSTMENT APPARATUS

[76] Inventor: Ming-Yaw Chen, 64 Tai Ping Rd., Taichung, Taiwan

[ * ] Notice: The portion of the term of this patent subsequent to Oct. 14, 2003 has been disclaimed.

[21] Appl. No.: 62,768

[22] Filed: Jun. 15, 1987

[51] Int. Cl.[4] ..... A61H 3/00; A47D 13/04

[52] U.S. Cl. ..... 272/70.3; 280/87.02 W; 280/649

[58] Field of Search ..... 272/70.3; 280/87.02 W, 280/649, 650; 297/5

[56] References Cited

U.S. PATENT DOCUMENTS

| | | | |
|---|---|---|---|
| 4,019,756 | 4/1977 | Ishida | 280/649 |
| 4,359,242 | 11/1982 | Garken et al. | 280/649 |
| 4,433,869 | 2/1984 | Payne, Jr. et al. | 280/650 |
| 4,576,392 | 3/1986 | Quinlan, Jr. | 280/87.02 W |
| 4,615,523 | 10/1986 | Chen | 272/70.3 |

*Primary Examiner*—Richard J. Apley
*Assistant Examiner*—J. Welsh
*Attorney, Agent, or Firm*—McGlew and Tuttle

[57] ABSTRACT

The present invention relates to a baby's walker with height adjustment apparatus which includes a seat; a slidable base; two U-shaped tubes pivotally connected to each other in crosswise arrangement and disposed between said seat and said slidable base, said U-shaped tubes each having a central portion and ends opposite said central portion, said ends being pivotally connected to said slidable base, said central portion of one of said U-shaped tubes being pivotally connected to one side of said seat, said central portion of the other of said U-shaped tubes being movably engaged to the underside of the opposite side of said seat; two plates secured on said underside of the opposite side of said seat in a parallel arrangement, which each plate having an indented portion formed at its underside; two sliding members provided on said movable central portion with a rectangular opening, and slidably engaged with said plates respectively; a controlling member pivotally connected with said movable central portion with a rectangular opening and having an engaging portion with an opening on the top and an operating portion opposite to said engaging portion, and two protuberances extended upwards; and a first spring member arranged between said sliding members and said engaging portion of said controlling member for biasing said controlling member to rotate in a direction that causes said protuberances to move upwards to engage with said indented portions respectively; a second elastic member arranged at said space of the controlling member with both ends sleeved to the movable central portion and that controlling member.

5 Claims, 4 Drawing Sheets

BABY'S WALKER WITH HEIGHT ADJUSTMENT APPARATUS

BACKGROUND OF THE INVENTION

The present invention relates to a baby's walker with height adjustment apparatus, and to a new baby's walker of simple and practical construction to increase comfort and safety when used.

In early designs, the height of the baby's walker could not be adjusted in accordance with the height of the baby, with the result that the baby's two feet would sometimes either be suspended or bent. In order to avoid said defect, the manufacturer has made a collapsible baby's walker with pivotally sleeved legs, enabling the height of baby's walker to be adjusted by engaging and disengaging two sets of indented portions. Height adjustable baby's walkers using said idea are well accepted by users and modern products have improved precision. For example, the present application has obtained U.S. Pat. No. 4,615,523 because the simple and practical construction and easy handling afforded by the invention disclosed therein is advantageous, when compared with the constructions of U.S. Pat. No. 4,019,756 "Baby's Walker" and U.S. Pat. No. 4,433,869.

U.S. Pat. No. 4,359,242 "Collapsible Baby's Walker-Jumper" discloses a new baby's walker with a vibration absorbing system. The design is based on the stiff seat of a conventional baby's walker in which the vibration occurring as a result of moving on an uneven surface would impose a sudden shock on the baby causing it to cry, furthermore providing an obstacle to the baby's growth. This prior construction has satisfied its predicted object but unfortunately, its complicated construction and difficulties in adjusting its height are serious defects.

The main objective of the present invention is to provide a baby's walker with a height adjustment apparatus incorporating a simple and practical member to absorb vibration.

In order to achieve said effect, the baby's walker comprises: a set base; two U-shaped tubes pivotally connected to each other in crosswise arrangement and disposed between said seat and said slidable base, said U-shaped tubes each having a central portion and ends opposite said central portion, said ends being pivotally connected to said slidable base, said central portion of one of said U-shaped tubes being pivotally connected to one side of seat, said central portion of the other of said U-shaped tubes being movably engaged to the underside of the opposite side of said seat; two plates secured on said underside of the opposite side of said seat in a parallel arrangement, each plate having an indented portion formed at its underside; two sliding members with respective rectangular openings receiving said movable central portion and slidably engaged with said plates respectively; a controlling member pivotally connected with said movable central portion and having a rectangular opening and an engaging portion with an opening on the top and an operating portion opposite to said engaging portion, and two protuberances extended upwards; and a first spring member arranged between said sliding members and said engaging portion of said controlling member for biasing said controlling member to rotate in a direction that causes said protuberances to move upwards to engage with said indented portions respectively; a second elastic member arranged at said space of the controlling member with both ends sleeved to the movable central portion and the controlling member.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

DETAILED DESCRIPTION OF THE PREFERRED EMBODIMENT

Figure 1:
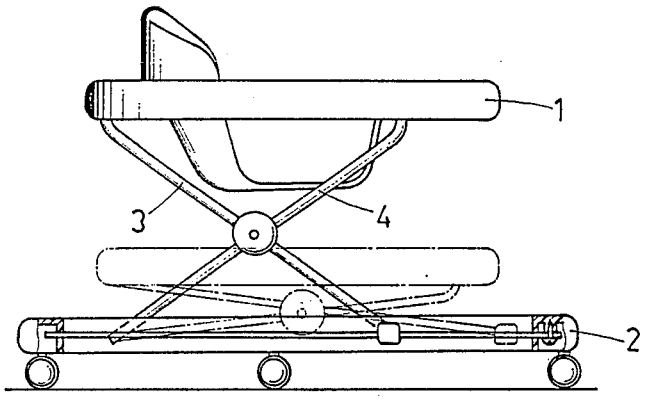
FIG. 1 is a side view of the baby's walker.

Referring first to FIG. 1, a walker includes a seat, a slidable base 2 under which a plurality of wheels are provided, and two U-shaped tubes 3 and 4 which are pivotally connected to each other in a crosswise arrangement and are placed between the seat 1 and the slidable base 2 with their ends pivotally connected to the slidable base 2 respectively, with the central portion of the tube 3 pivotally connected to the back of the seat 1, and the central portion of the tube 4 movably engaged to the underside of the opposite front side of the seat 1 through an adjusting apparatus in the manner hereinafter described.

Figure 2:
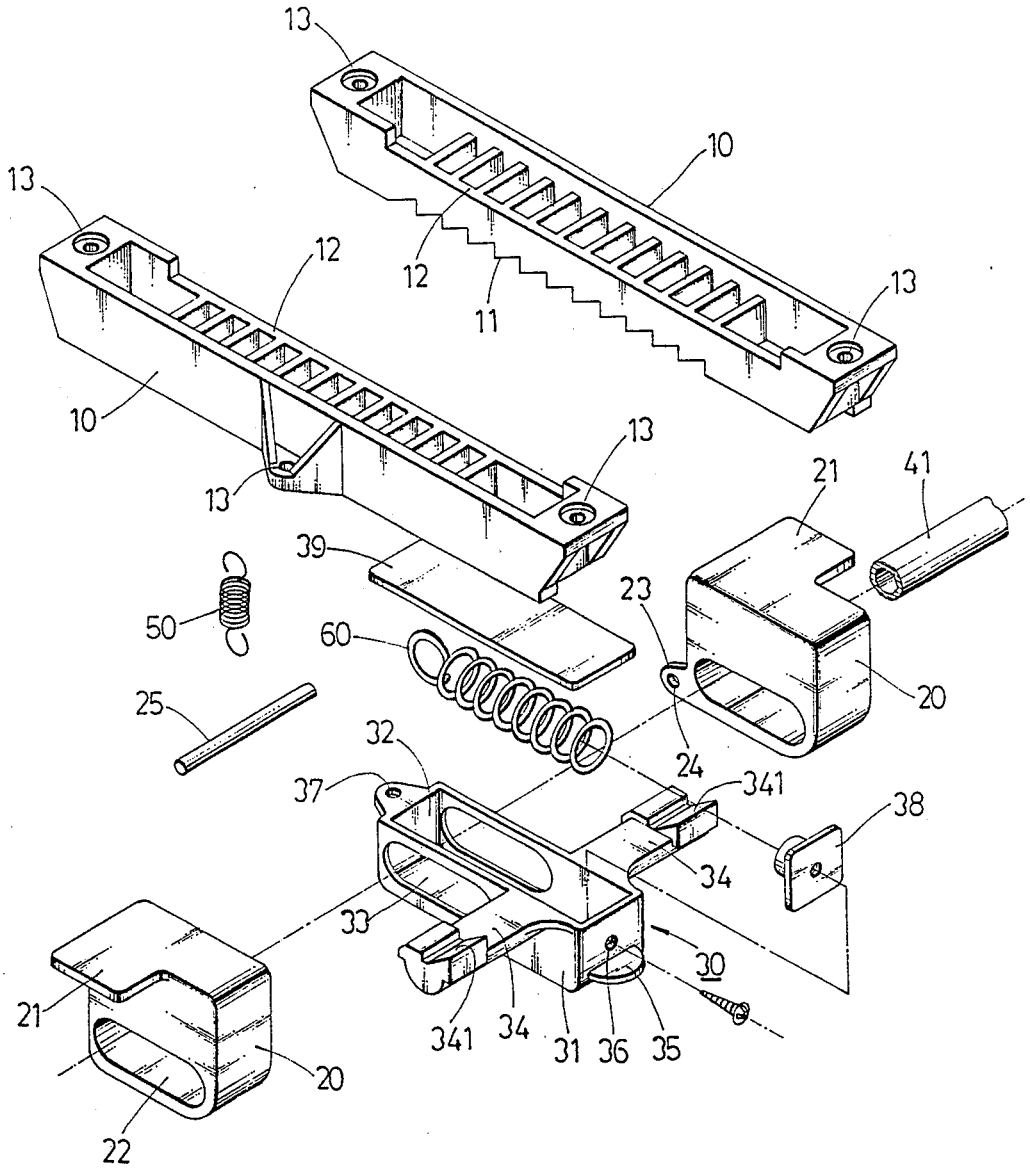
FIG. 2 is an exploded perspective view of the preferred embodiment.

As shown in FIG. 2, the adjusting apparatus for a walker comprises two plates 10 having respective indented portions 11 formed at their undersides, two sliding members 10, a controlling member 30, a first spring member 50, and a second spring member 60. The plates 10 are secured on the underside of the seat 1 in a parallel arrangement by several screws (not shown) screwed through the corresponding holes 13. Each plate 10 has a groove 12 thereon extended inward through its sidewall and preferably on its top. The sliding members 20 have respective rectangular openings 22 therethrough for sleeving on the central portion 41 of the tube 4, respective upper extension portions 21 extending into the grooves 12 of the plates 10, and respective lower extension portion 23 having respective apertures 24 thereon. A rod 25 is fixed between the apertures 24 of the lower extension portions 23, and serves to separate the two sliding members 20 by an appropriate distance, so that the sliding member 20 can be maintained at the position between the plates 10 with their upper extension portions 21 slidably resting on the grooves 12 respectively.

The controlling member 30 is of blind-ended channel shape defining a cavity 32 and having slots 33 extending through opposite channel side walls for sleeving it onto the central portion 42 of the tube 4 between the sliding members 20, an operating portion 35 extending forwardly from the channel base, an engaging portion 32 having a hole 36 in a front channel end, and a hole 37 in a lug extending therein rearwardly from a channel end, a plate 38 being positioned in the channel in abutment with the front channel end by a screw extending through the hole 36; a cover plate 39 closes the channel and two arms 34 extend laterally from respective opposite side walls. At the end of each arm 34 a protuberance 341 of triangular shape extends upwards. The first spring member 50 is a helical tension type spring, and is arranged with one end fixed in the hole 37 of the engaging portion 31 and the other end fixed on the rod 25. The second spring member 50 is a compression spring, and is arranged in the cavity 32 of the controlling member 30 with one end sleeved in the central portion 41 of the tube 4 and another end into the fixed plate 38. Accordingly, under normal conditions, the first spring member 50 will bias the controlling member 30 to rotate with respect to the central portion 41 is a direction such that the protuberances 341 are moved upwards to engage with the indented portion 11 respectively. When the operating portion 35 of the controlling member 30 is manually pressed down, the controlling member 30 will rotate in an opposite direction so that the protuberances 341 are moved downwards to disengage from an indented portion 11 against the biasing force of the first spring member 50.

Figure 3:
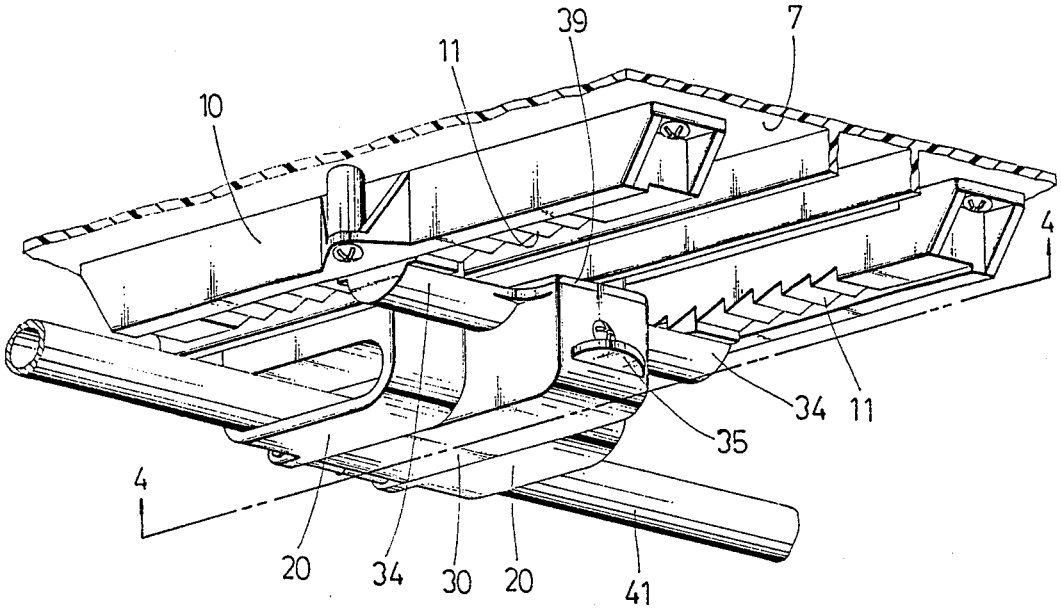
FIG. 3 is a bottom plan view composition of FIG. 2.
Figure 4:
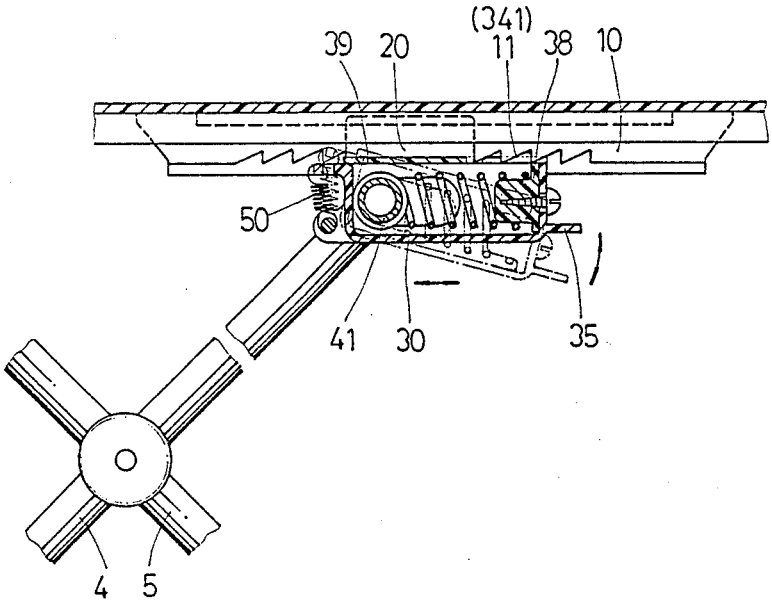
FIG. 4 is a cross section along line 44 of FIG. 3, phantom lines showing how to operate the height adjustment apparatus.

With reference to FIG. 3, there is shown the adjusting apparatus of the present invention mounted on a walker. In the operation of the adjustment in height, the user can merely use one finger to press the operation portion 35 of the controlling member 30 downwards against the bias force of the first spring member 50 for the protuberances 341 to disengage from the indented portion 11, slide the sliding members 20 with the central portion 41 of the U-shaped tube 4 to a desired position, and then release his finger, resulting in that the first spring member 50 biases the controlling member 30 to rotate upwards and consequently the protuberances 341 and the indented portions 11 become engaged with one another.

Figure 5:
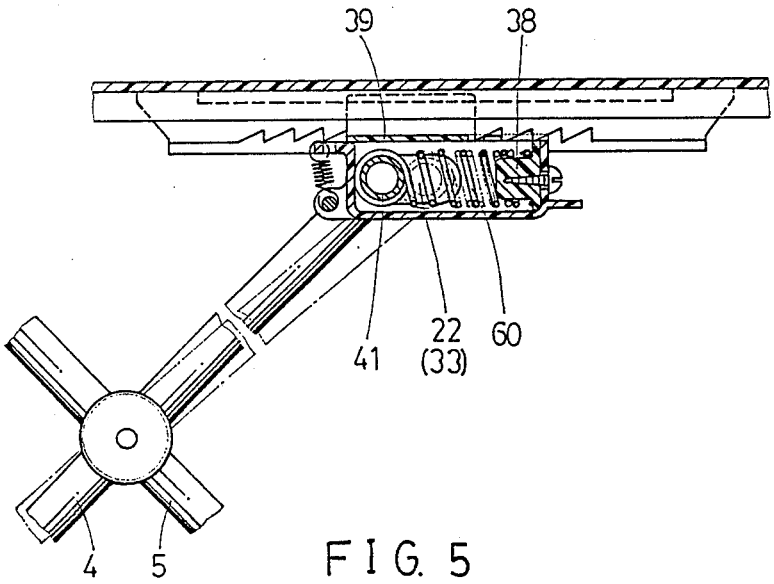
FIG. 5 is a similar view to FIG. 4, phantom lines showing deformation which occurs when a baby is sitting on the walker.

As shown in FIG. 5, when a baby is sitting on the baby's walker and moves on uneven ground surface, a reaction force acts on the U-shaped tubes 3, 4, this force makes the left U-shaped tube 4 displace forwards when the central portion 41 will move along the rectangular holes 22, 33 of the sliding members 20 and the controlling member 30 to depress the second spring member 60, and the vibration will be absorbed by the second spring member 60.

Figure 6:
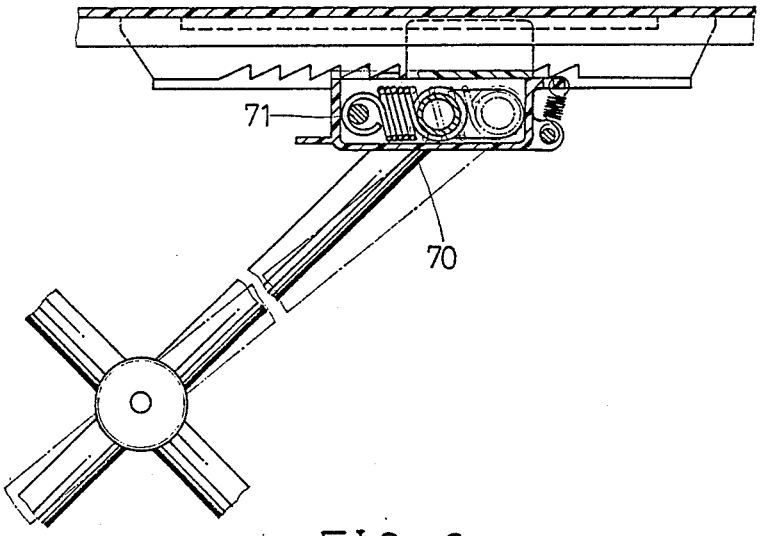
FIG. 6 is similar to FIG. 5 showing a cross-section of a detail of another preferred embodiment for the present invention.

Please refer to FIG. 6 showing another preferred embodiment of the present invention, basically not much different from FIG. 2–5 but installation is reversed through 180° and the second spring member 70 is modified as a helical tension type for vibration absorbing function, a pin 71 being positioned at the controlling member as a fixed member.

While specific embodiments of the invention have been shown and described in detail to illustrate the application of the principles of the invention, it will be understood that the invention may be embodied otherwise without departing from such principles.

I claim:

1. A baby's walker with height adjustment apparatus comprising:

a seat;

a slidable base;

two U-shaped tubes pivotally connected to each other in crosswise arrangement and disposed between said seat and said slidable base, said U-shaped tubes each having a central portion and ends opposite said central portion, said ends being pivotally connected to said slidable base, said central portion of one of said U-shaped tubes being pivotally connected to one side of said seat, said central portion of the other of said U-shaped tubes being movably engaged to the underside of the opposite side of said seat;

two plates secured on said underside of the opposite side of said seat in a parallel arrangement, with each plate having an indented portion formed at its underside;

two sliding members having respective slots receiving said movable central portion, and slidably engaged with said plates respectively;

a controlling member defining a cavity with a cavity wall formed with a slot receiving said movable central portion in a pivotal connection and having an engaging portion and an operating portion opposite to said engaging portion, and two protuberances extended upwards; and a first spring member arranged between said sliding members and said engaging portion of said controlling member for biasing said controlling member to rotate in a direction that causes said protuberances to move upwards to engage with said indented portions rspectively;

a second spring member located in the cavity of the controlling member and having opposite ends connected to the movable central portion and the controlling member, respectively, for resisting movement of the movable central portion along the slots.

2. A baby's walker with height adjustment apparatus as claimed in claim 1 wherein the second spring member is a compression spring.

3. A baby's walker with height adjustment apparatus as claimed in claim 2 wherein the cavity of the controlling member is provided with a fixed plate, and a pin extends from said fixed plate to provide a sleeved head locating the second spring member.

4. A baby's walker with height adjustment apparatus as claimed in claim 1 wherein the second spring member is a helical tension type spring, and a pin is provided in the cavity of the controlling member for securing one end of the spring.

5. A baby's walker with height adjustment apparatus as claimed in claim 1, wherein the cavity of the controlling member is closed by a cover plate.

* * * * *